US010830028B2

(12) United States Patent
Richard et al.

(10) Patent No.: US 10,830,028 B2
(45) Date of Patent: Nov. 10, 2020

(54) FRAC OPTIMIZATION USING ICD TECHNOLOGY

(71) Applicant: BAKER HUGHES INCORPORATED, Houston, TX (US)

(72) Inventors: Bennett M. Richard, Kingwood, TX (US); Gonzalo Garcia, Houston, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 0 days.

(21) Appl. No.: 14/174,554

(22) Filed: Feb. 6, 2014

(65) Prior Publication Data

US 2014/0216754 A1 Aug. 7, 2014

Related U.S. Application Data

(60) Provisional application No. 61/762,221, filed on Feb. 7, 2013.

(51) Int. Cl.

| | |
|---|---|
| ***E21B 43/12*** | (2006.01) |
| ***E21B 43/26*** | (2006.01) |
| ***E21B 43/08*** | (2006.01) |
| *E21B 43/32* | (2006.01) |

(52) U.S. Cl.
CPC ..... *E21B 43/26* (2013.01); *E21B 43/08* (2013.01); *E21B 43/12* (2013.01); *E21B 43/32* (2013.01)

(58) Field of Classification Search
CPC ..... E21B 43/12; E21B 34/14; E21B 2034/007
See application file for complete search history.

(56) References Cited

U.S. PATENT DOCUMENTS

| | | | | |
|---|---|---|---|---|
| 5,896,928 | A * | 4/1999 | Coon | E21B 43/12 166/205 |
| 6,112,817 | A | 9/2000 | Voll et al. | |
| 6,494,265 | B2 | 12/2002 | Wilson et al. | |
| 7,409,999 | B2 | 8/2008 | Henriksen et al. | |
| 7,591,312 | B2 | 9/2009 | Johnson et al. | |
| 7,757,761 | B2 | 7/2010 | Augustine | |
| 7,775,283 | B2 | 8/2010 | Coronado et al. | |
| 7,823,645 | B2 | 11/2010 | Henriksen et al. | |
| 7,909,088 | B2 | 3/2011 | O'Malley et al. | |
| 7,913,765 | B2 | 3/2011 | Crow et al. | |
| 7,954,546 | B2 | 6/2011 | Kim et al. | |
| 7,980,265 | B2 | 7/2011 | Holmes et al. | |
| 7,992,637 | B2 | 8/2011 | Garcia | |

(Continued)

FOREIGN PATENT DOCUMENTS

WO 2012037645 A1 3/2012

OTHER PUBLICATIONS

PCT/US2014/015288—International Search Report dated Nov. 20, 2014.

*Primary Examiner* — Kipp C Wallace
(74) *Attorney, Agent, or Firm* — Mossman, Kumar & Tyler PC

(57) ABSTRACT

An apparatus for controlling a flow of a fluid between a wellbore tubular and a formation may include a frac tool having at least one port in selective fluid communication with the formation, and an inflow control device having a flow control path configured to provide a predetermined pressure drop for a flowing fluid. The inflow control device may have a flow coupler configured to provide selective fluid communication with the at least one port.

11 Claims, 2 Drawing Sheets

(56) References Cited

U.S. PATENT DOCUMENTS

| | | | | |
|---|---|---|---|---|
| 8,069,921 | B2 | 12/2011 | Garcia et al. | |
| 8,096,351 | B2 | 1/2012 | Peterson et al. | |
| 8,104,538 | B2 | 1/2012 | Richard et al. | |
| 8,151,881 | B2 | 4/2012 | Johnson et al. | |
| 8,210,258 | B2 | 7/2012 | O'Malley et al. | |
| 8,312,931 | B2 | 11/2012 | Xu et al. | |
| 8,342,245 | B2 | 1/2013 | Richard et al. | |
| 8,403,038 | B2 | 3/2013 | Russell et al. | |
| 8,403,061 | B2 | 3/2013 | Russell et al. | |
| 8,424,609 | B2 | 4/2013 | Duphorne et al. | |
| 8,443,888 | B2 | 5/2013 | Coronado | |
| 8,443,892 | B2 | 5/2013 | Richard et al. | |
| 8,469,105 | B2 | 6/2013 | O'Malley et al. | |
| 8,469,107 | B2 | 6/2013 | O'Malley et al. | |
| 8,527,100 | B2 | 9/2013 | Russell et al. | |
| 8,544,548 | B2 | 10/2013 | Coronado et al. | |
| 8,550,166 | B2 | 10/2013 | Xu et al. | |
| 8,646,535 | B2 | 2/2014 | Xu et al. | |
| 8,678,350 | B2 | 3/2014 | Coull | |
| 9,080,421 | B2 * | 7/2015 | Holderman | E21B 34/14 |
| 2006/0278399 | A1 | 12/2006 | Dwivedi et al. | |
| 2008/0006413 | A1 * | 1/2008 | Le Gloahec | E21B 43/084 166/369 |
| 2008/0041588 | A1 * | 2/2008 | Richards | E21B 34/08 166/265 |
| 2009/0065199 | A1 * | 3/2009 | Patel | E21B 23/03 166/250.01 |
| 2009/0084553 | A1 * | 4/2009 | Rytlewski | E21B 34/06 166/305.1 |
| 2011/0030969 | A1 | 2/2011 | Richards | |
| 2012/0048559 | A1 * | 3/2012 | Ganguly | E21B 43/26 166/308.1 |
| 2012/0168164 | A1 | 7/2012 | Sun et al. | |
| 2013/0319664 | A1 * | 12/2013 | McNamee | E21B 34/08 166/276 |

* cited by examiner

FRAC OPTIMIZATION USING ICD TECHNOLOGY

CROSS-REFERENCE TO RELATED APPLICATIONS

This applications claims priority from U.S. Provisional Application Ser. No. 61/762,221, filed Feb. 7, 2013, the disclosure of which is incorporated herein by reference in its entirety.

BACKGROUND OF THE DISCLOSURE

1. Field of the Disclosure

The disclosure relates generally to systems and methods for performing completion and production activities in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. Sometimes it is desirable to treat the formation in some manner in order to improve production. One type of treatment is a "frac" operation. It is also desirable to control drainage along the production zone or zones to reduce undesirable conditions such as an invasive gas cone, water cone, and/or harmful flow patterns.

The present disclosure addresses these and other needs of the prior art.

SUMMARY OF THE DISCLOSURE

In aspects, the present disclosure provides an apparatus for controlling a flow of a fluid between a wellbore tubular and a formation. The apparatus may include a frac tool having at least one port in selective fluid communication with the formation, and an inflow control device having a flow control path configured to provide a predetermined pressure drop for a flowing fluid. The inflow control device may have a flow coupler configured to provide selective fluid communication with the at least one port.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION

Figure 1:
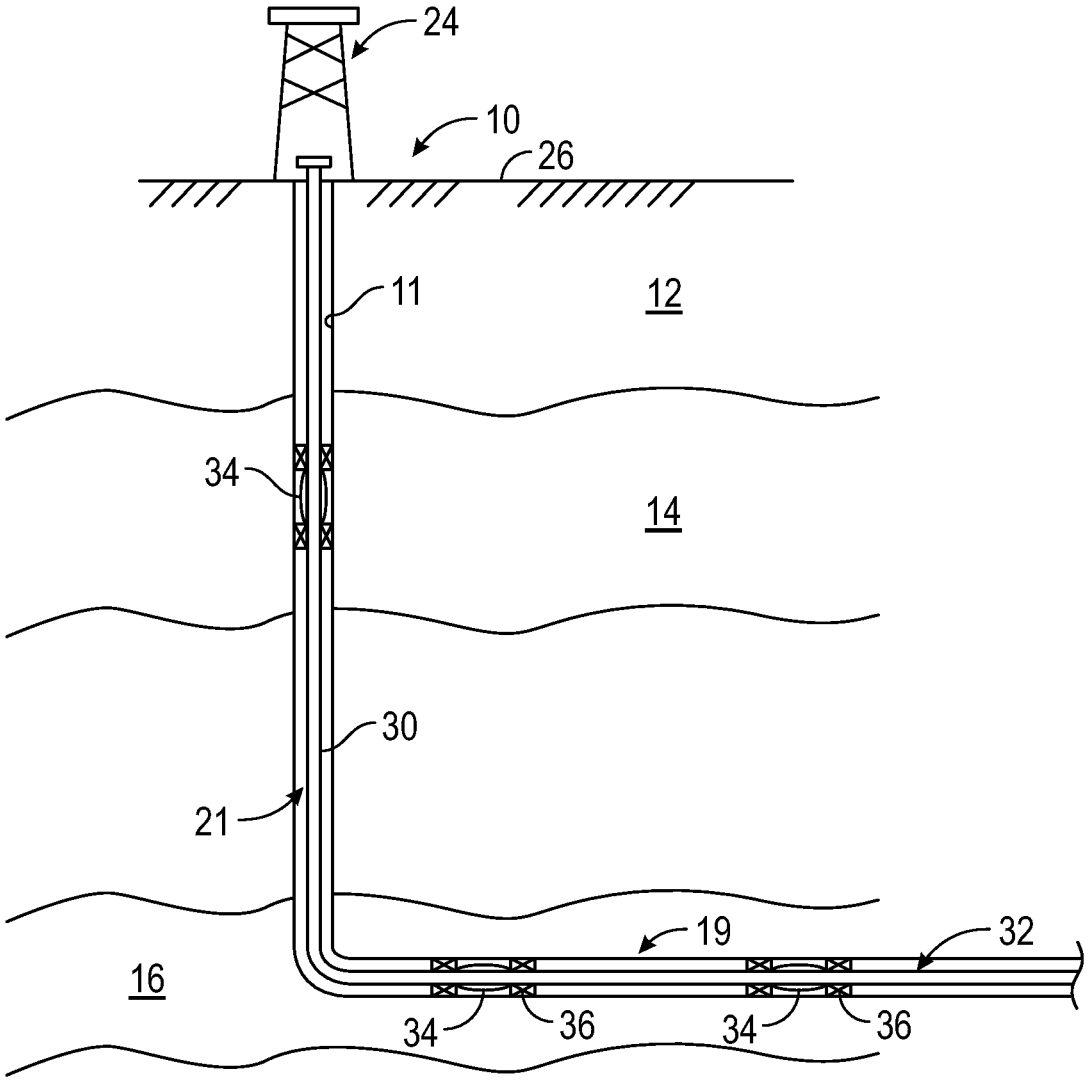
FIG. 1 is a schematic elevation view of an exemplary open hole production string which incorporates a flow control system having a frac tool and an inflow control device in accordance with one embodiment of the present disclosure.

FIG. 1 illustrates a well 10 that incorporates well devices of the present disclosure. The well 10 includes an open hole wellbore 11 that has been drilled through the earth 12 into formation 16 from which it is desired to produce hydrocarbons. The wellbore 10 has a deviated or substantially horizontal leg 19. The wellbore 10 has a late-stage production assembly disposed therein by a production tubing string 20 that extends downwardly from a wellhead 24 at the surface 26 of the wellbore 10. The production string 20 defines an internal axial flow bore along its length. An annulus 30 is defined between the production string 20 and the wall defining the wellbore 11. The production string 20 has a deviated, generally horizontal portion 32 that extends along the deviated leg 19 of the wellbore 10. Production devices 34 are positioned at selected points along the production string 20. Optionally, each production device 34 is isolated within the wellbore 10 by a pair of packer devices 36. Although only a few production devices 34 are shown in FIG. 1, there may, in fact, be a large number of such devices arranged in serial fashion along the horizontal portion 32.

Each production device 34 is used to govern one or more aspects of a flow of one or more fluids into or out of the production string 20. As used herein, the term "fluid" or "fluids" includes liquids, gases, hydrocarbons, multi-phase fluids, mixtures of two of more fluids, water, brine, engineered fluids such as drilling mud, fluids injected from the surface such as water, and naturally occurring fluids such as oil and gas.

The wellbore 11 is "open hole," meaning the wellbore arrangement 11 has an uncased borehole that is directly open to the formation 16. Production fluids, therefore, flow directly from the formation, 16, and into the annulus 30 or production nipples that is defined between the production string 21 and the wall of the wellbore 11.

Figure 2:
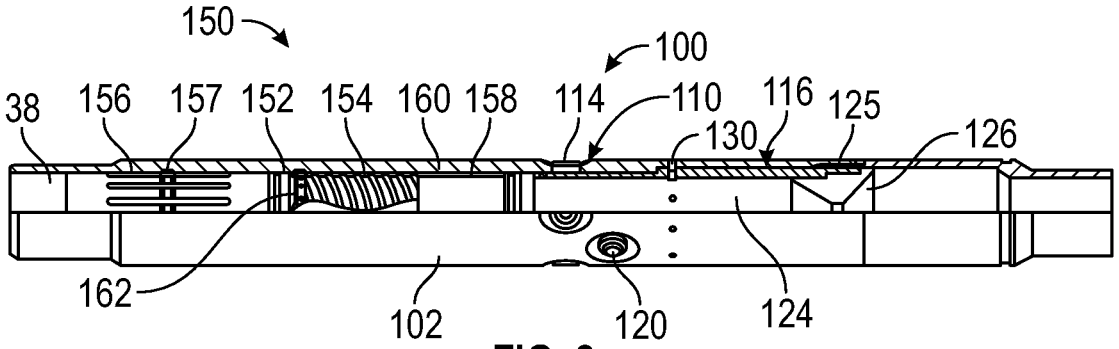
FIG. 2 is a sectional view of a flow control system made in accordance with one embodiment of the present disclosure that is in a pre-activated condition.

Referring now to FIG. 2, there is shown one embodiment of a multi-purpose well device 100 for controlling the flow of fluids between a reservoir and a flow bore 38 of a production string (e.g., production tubing string 20 of FIG. 1). The well device 100 is referred to as "multi-purpose" because it may be used to perform two more discrete operations. In one arrangement, the well device 100 includes a housing 102 that includes frac tool 110 for hydraulically fracturing a formation and an inflow control device 150 for controlling inflow from the formation and/or injection flow into the formation. While the housing 102 is shown as a unitary body, the housing 102 may be formed of two or more separate but interconnected housings. Illustrative embodiments are discussed below.

The frac tool 110 may be used to hydraulically fracture an adjacent formation to enhance fluid mobility. In one embodiment, the frac tool 110 has ports 114 that provide fluid communication between the flow bore 38 and the formation or the annular space 30 (FIG. 1) surrounding the housing 102. The frac tool 110 also has a closure device 116 for selectively isolating the ports 114.

Figure 3:
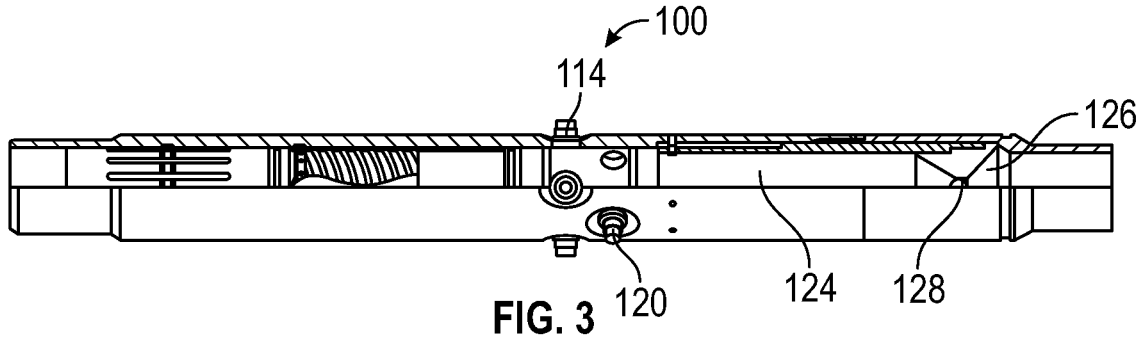
FIG. 3 is a sectional view of a flow control system made in accordance with one embodiment of the present disclosure after the frac tool has been activated.

The ports 114, which may include an array of telescoping members 120, are circumferentially distributed around an outer surface of the housing 102. The array may have any number or size of ports 114 as needed for the expected flow rates for fracturing or subsequent production. The telescoping members 120 are shown in the retracted position in FIG. 2. In some embodiments, the telescoping members 120 are initially obstructed with a temporary plug (not shown) so that internal pressure in the flow bore 38 will result in telescoping extension between or among members in each assembly. The closure device 116 for selectively isolating the ports 114 may include a sliding sleeve 124 and an actuator 125. The sliding sleeve 124 is disposed inside the housing 102 and may slide between a sealing position and an open position. As shown in FIG. 2, prior to actuation, the sliding sleeve 124 is in a sealing engagement with the ports 114. That is, the sliding sleeve 124 is coupled to the ports 124 to prevent fluid flow between the ports 124 and a flow bore 38 of the wellbore tubular such as the production string 21. The actuator 125 may be used to slide the sliding sleeve 124 out of engagement with the ports 114. The actuator may be a mechanical device, an electromechanical device, or hydraulically actuated. In one embodiment, the actuator 125 may include a seat 126 and a pump down ball 128 (FIG. 3). The sliding sleeve 124 may be axially shifted using the pressure differential generated when the ball 128 lands on the seat 126. The closure device 116 may include a frangible member 130, which may be a shear pin that locks the sliding sleeve 124 to the housing 102. In one embodiment, the seats and balls that land on them are all different sizes and the sleeves can be opened in a bottom up sequence by first landing smaller balls on smaller seats that are on the lower assemblies 34 (FIG. 1) and progressively dropping larger balls that will land on different seats to activate the actuators 125.

The inflow control device 150 may be positioned axially adjacent to the frac tool 110. In one embodiment, the inflow control device 150 control one or more characteristics of fluid flow between a formation and the flow bore 38. The in-flow control device 150 may include a mandrel 152 that slides axially inside the housing 102. The mandrel may include a flow control passage 154, a latching section 156, and a flow coupler 158. The flow coupler 158 may be a sleeve-like member that has an outer circumferential surface separated by an annular gap 160 from an inner surface of the housing 102. The flow coupler 158 may include one or more sealing elements that prevent fluid communication between the gap 160 and the flow bore 38.

The flow control passage 154 is configured to impose one or more flow characteristics (e.g., controlled pressure drops) on the fluid flow through the inflow control device 150. For example, the flow control passage 154 may include helical passage ways that wind along an outer surface of the mandrel 152. The helical passage, which may include two or more parallel passages, may generate a pressure drop using frictional forces resisting flow along this circuitous flow path. When the flow coupler 158 is coupled to the ports 114, fluid flow between the interior and the exterior of the tool 100 occurs only through the ports 114, the flow coupler 158, and the flow control passage 154. The fluid, in some embodiments, may also flow through the openings 162 in the mandrel 152.

The latching section 156 may be used to axially shift the mandrel 152 and move the flow coupler 158 into fluid contact with the ports 114. In embodiments, the latching section 156 may include collets, profiles, locking dogs, or other elements device that connect to complementary features on a running tool (not shown). As shown, the latching section 156 may include a locking dog 157 that locks the mandrel 152 to the housing 102 until shifted by the running tool (not shown). Alternatively, the shifting could be accomplished electronically.

An illustrative use of the well tool 100 will be described with reference to FIGS. 2-4.

FIG. 2 shows the well tool 100 in a "running-in" position. That is, the frac tool 110 and the inflow control device 150 are both in their pre-activated positions. Specifically, the nozzles 120 are radially retracted and the sleeve 124 is sealingly coupled to and isolates the ports 114 from fluid pressure inside the bore 38. The mandrel 152 of the inflow control device 150 is nested such that the flow coupler 158 is axially recessed and separated from the ports 114.

FIG. 3 shows the well tool 100 positioned at the desired depth along the wellbore. To initiate a frac operation, the ball 128 is pumped down the flow bore 38 until it sealingly seals against the seat 126. Continued pumping of fluid generates a pressure differential that eventually breaks the retaining elements (shear pins) 130 and release the sliding sleeve 124. Because the seat 126 is fixed to the sleeve 124, this differential pressure slides the sleeve 124 from the position shown in FIG. 2 to the position shown in FIG. 3, wherein the ports 114 are exposed to fluid pressure in the flow bore 38. Thereafter, pressure is further increased to extend the nozzles 120 radially outward as shown in FIG. 3. At this point, frac fluid may be pumped into the flow bore 38 and ejected into the formation via the nozzles 120.

After the frac operation has been completed, a conventional shifting tool (not shown) may be conveyed into flow bore 38 using coiled tubing or other tool carrier. The shifting tool (not shown) may be manipulated as needed to mechanically engage the latching section 156. Once so connected, the shifting tool (not shown) is axially displaced, which causes the mandrel 152 to also slide until the flow coupler 158 is radially aligned with and coupled to the ports 114. Thereafter, the shifting tool (not shown) is disconnected from the mandrel 152 and retrieved to the surface. Alternatively, this same procedure could be accomplished electronically using wire or wireless transmission. The inflow control device 150 is now in the position shown in FIG. 4. Specifically, a fluid pathway is established between the formation and the flow bore 38 via the mandrel ports 162, flow control path 154, flow coupler 158, and the ports 114/nozzles 120. The coupling between the flow coupler 158 and the ports 114 is sealed such that that fluid flows only between the ports 114 and the flow control path 154. Finally, the pressure in the flow bore 38 may be further increased to push the ball 128 through the seat 126 and restore unobstructed fluid communication along the bore 38.

This process may be repeated for every well device 100 in the wellbore. To prepare for production or injection operations, a milling operation may be performed by drilling out the seats 126 and other obstructions along the flow bore 38.

The teachings of the present disclosure are not limited to any particular well configuration or any particular design for the frac tool or inflow control device. For example, while a single horizontal leg is shown in FIG. 1, the present disclosure may be also applied to wells having multiple branch bores that may have varying degrees of deviation from a vertical. Likewise, a variety of design and methodologies may be utilized in for the frac tool and inflow control devices. Non-limiting variants are discussed below for each component.

Figure 4:
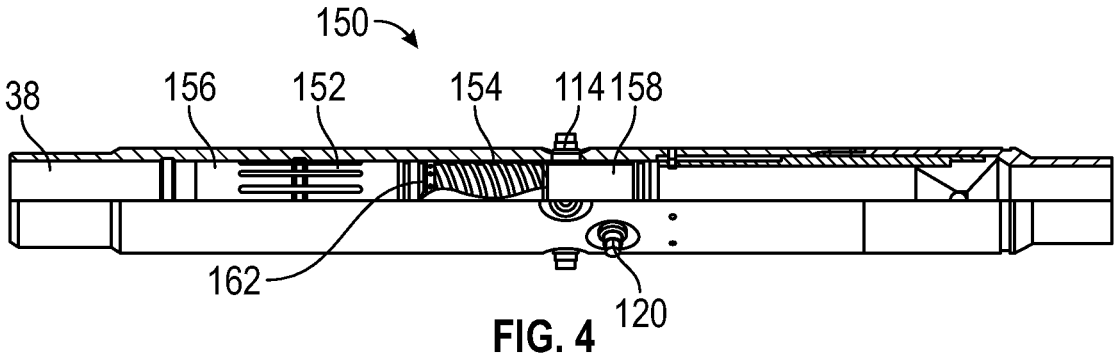
FIG. 4 is a sectional view of a flow control system made in accordance with one embodiment of the present disclosure after the inflow control device has also been activated.

While FIGS. 2-4 show the frac tool 110 using telescoping nozzle assemblies, other designs are envisioned that can effectively span the gap of the surrounding annulus in a manner to engage the formation in a manner that facilitates pressure transmission and reduces pressure or fluid loss into the surrounding annulus. For example, the bottomhole assembly may use a swelling material or a shape memory polymer to fill the surrounding annular space 30 (FIG. 1). In still other embodiments, the ports 114 may not use any telescoping feature.

Likewise, while the Figures show the inflow control device 150 using helical passages for generating a pressure drop, other configurations may be used to control flow rate, velocity, and pressure drops. In one embodiment, the flow control passage 154 may be a labyrinth-type passage that has a non-helical tortuous flow path. The tortousity of the passage may be obtained by using circular, diagonal, or curved passage way. These passage ways may wind around the other surface of the mandrel 152 to form a flow path that generates a gradual pressure drop using primarily frictional flow resistance. In other embodiments, a relatively sharp pressure drop may be generated using openings formed as orifices. Additionally, the flow control passage 154 may include two or more parallel fluid paths that are hydraulically isolated from one and other. These hydraulically isolated paths may each be configured to generate a different flow condition (e.g., different pressure drops). In such a hydraulically parallel arrangements, a user can select which of the paths may be open or closed in order to generate a desired pressure drop, flow rate, or other flow characteristic.

Moreover, the flow control passage may incorporate one or more features that control friction factors, flow path surface properties, and flow path geometry and dimensions. The flow control passages may also include hydrophilic or hydrophobic materials. These features, separately or in combination, may cause flow characteristics to vary as fluid with different fluid properties (e.g., density and viscosity) flow through the inflow device 150.

In still other embodiments, the flow path 152 may include a permeable media that is formulated, structured, or otherwise configured to generate a desired pressure drop. Illustrative permeable media include, but are not limited to, packed ball bearings, beads, or pellets, or fibrous elements, a packed body of ion exchange resin beads, and swellable media. The beads may be formed as balls having little or no permeability. The permeable media may be responsive to the amount of water in a fluid; e.g., the permeable media may increase resistance to inflow as water cut increases.

The well tools of the present disclosure may be distributed along a section of a production well to provide fluid control at multiple locations. This can be useful, for example, to impose a desired drainage or production influx pattern. By appropriately configuring these well tools, a well owner can increase the likelihood that an oil or gas bearing reservoir will drain efficiently. This drainage pattern may include equal drainage from all zones or individualized and different drainage rates for one or more production zones. During injection operations, wherein a fluid such as water or steam is directed into the reservoir, the well tools may be used to distribute the injected fluid in a desired manner. It should be understood that the teachings of the present disclosure may readily be applied to other situations such as geothermal wells, water producing wells, etc. ICD's of the present disclosure may improve the influx (bpd/ft) since additional pressure drops across the frac sleeve may promote uniform flow coming to the base pipe. The pressure drops may also be used to mitigate cross flow in some of the fractures. Such cross flow may reduce the flow rate per unit time since flow is re-injected through the fractures. ICD's may also enable the establishing of "rule of thumb" for the optimum stages number given the average perm—to mitigate flow interference.

The influx (bpd/fx) is affected by: the pressure drop in the base pipe, the reservoir heterogeneities, the mobility ratio and variations of reservoir pressure along the wellbore. If one of those factors are present along the wellbore the amount of fluid coming into the base pipe will be uneven.

If variations of the reservoir pressure along the wellbore are greater than pressure drop in the base pipe, then cross-flow between fractures could occur. The cross-flow between fractures is an operational condition. To identify this condition in frac point operations, a production logging tool may be run. Space for this tool may be provided by milling the ball seat or using dissolved material. If cross-flow occurs, the flow rate could improve over time, but profitability would improve if cross-flow is immediately addressed. The ICD solution may assist to address others issues as mobility control (water or gas production), uneven fluid and cross-flow.

An ICD generally requires additional pressure drop through the completion to deliver equal or approximately equal amount of fluid coming into the base pipe. Low reservoir pressure and low permeability may or may not be able to accommodate such a pressure drop. In most cases, the ICD pressure drop should be greater than the reservoir pressure minus the pressure drop through the porous media (reservoir). If the pressure drop is less, the ICD pressure drop will be transparent to the reservoir and there will not be enough pressure to control the flow.

The basepipe diameter reduction may be optimized in low viscosity fluid condition since the pressure drop (in the production mode) in the base pipe will not affect the influx. The maximum flow rate to not exceed erosion limits may be the constraint. However, in the pumping direction that could be a restriction to pump high proppant concentration at high flow rate.

The ICD geometry will play a role to not exceed the erosion limits and no plugging issues (in fracturing condition that is not the case). That is, the pressure drop required to balance the flow could be due to changes of flow area (orifice ICD) or others pressure drop mechanism (friction or tortuosity, or combination of both).

For the sake of clarity and brevity, descriptions of most threaded connections between tubular elements, elastomeric seals, such as o-rings, and other well-understood techniques are omitted in the above description. Further, terms such as "slot," "passages," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid between a wellbore tubular and a formation, comprising:

a frac tool having at least one port in selective fluid communication with the formation; and an inflow control device comprising a mandrel and having a flow control path configured to provide a predetermined pressure drop for a flowing fluid, the inflow control device having a flow coupler configured to provide selective fluid communication with the at least one port, wherein the flow coupler is configured to slide between a connected and a disconnected position, wherein the flow control path communicates with the at least one port when the flow coupler is in the connected position and is separated from the at least one port when the flow coupler is in the disconnected position, wherein fluid flows only between the at least one port and the flow control path when the flow coupler is in the connected position, and wherein all of the flow control path of the inflow control device is axially adjacent to the frac tool when the flow coupler is in the connected position, wherein the frac tool includes a closure device for selectively isolating the at least one port from a flow bore of the wellbore tubular, wherein the closure device includes a sleeve and an actuator, wherein the actuator is configured to slide the sleeve out of engagement with the at least one port, and wherein the flow control path includes: (i) at least one circuitous flow path that winds around the outer surface of the mandrel, (ii) at least two hydraulically parallel flow paths; and (iii) a helical flow path.

2. The apparatus according to claim 1, wherein the flow coupler slides to a connected position after the actuator slides the sleeve out of engagement with the at least one port.

3. A method for controlling a flow of a fluid between a wellbore tubular and a formation, comprising:

positioning a frac tool in a wellbore formed in the formation, the frac tool having at least one port in selective fluid communication with the formation;

isolating the at least one port from a flow bore of the wellbore with a closure member in the frac tool, wherein the closure member includes a sleeve and an actuator, sliding the sleeve out of engagement with the at least one port with the actuator, positioning an inflow control device in the wellbore, the inflow control device having a flow control path configured to provide a predetermined pressure drop for a flowing fluid, the inflow control device having a flow coupler configured to provide selective fluid communication with the at least one port;

positioning at least one annular surface directly radially inward of the at least one port opening after sliding the sleeve out of engagement with the at least one port, the at least one annular surface being formed on an outer surface of the flow coupler, the at least one port being positioned between the formation and the at least one annular outer surface; and completely blocking radial flow of fluid toward a center of the wellbore tubular with the at least one annular surface, thereby directing the fluid flow longitudinally along the flow control path.

4. The method according to claim 3, wherein the flow coupler is configured to slide between a connected and a disconnected position, and further comprising sliding the flow coupler from the disconnected position to the connected position to establish fluid communication between the flow control path and the at least one port.

5. The method according to claim 3, wherein the flow control path includes one of: (i) at least one circuitous flow path; (ii) at least two hydraulically isolated flow paths, (iii) a permeable media, (iv) a bead pack.

6. The method of claim 3, wherein:

the frac tool includes a housing on which the at least one port is disposed, and the flow coupler is slidably disposed inside the housing and forming an annular flow space inside the housing; and and coupling the flow coupler to the at least one port to allow fluid communication between the at least one port and the bore of the wellbore tubular only through the flow control path.

7. The method of claim 6, further comprising:

forming a sealing engagement of the closure member with the at least one port to prevent fluid communication through the at least one member;

decoupling the closure member from the at least one port; and forming a sealing engagement between the flow coupler and the at least one port to allow fluid communication only between the flow control path and the at least one port.

8. An apparatus for controlling a flow of a fluid between a wellbore tubular and a formation, comprising:

a frac tool having at least one port in selective fluid communication with the formation; wherein the frac tool includes a closure device for selectively isolating the at least one port from a flow bore of the wellbore tubular, wherein the closure device includes a sleeve and an actuator, wherein the actuator is configured to slide the sleeve out of engagement with the at least one port, an inflow control device having a flow control path configured to provide a predetermined pressure drop for a flowing fluid, the inflow control device having a flow coupler configured to provide selective fluid communication with the at least one port, the predetermined pressure drop being at least enough to control fluid flow from the formation; and a mandrel having at least one opening in communication with a bore of the wellbore tubular, wherein the at least one port, the flow control path, and the at least one opening are arranged axially side-by-side, and wherein all the fluid flowing into the at least one port exits via the at least one opening after flowing along a distance parallel with the wellbore via the flow control path and exits at the at least one opening, wherein the flow coupler is configured to slide between a connected and a disconnected position, and wherein sliding the flow coupler from the disconnected position to the connected position establishes fluid communication between the flow control path and the at least one port and places the port radially between the flow coupler and the formation.

9. The apparatus of claim 8, wherein the flow control path is formed on an outer surface of the mandrel.

10. The apparatus of claim 9, wherein the flow control path includes at least one circuitous flow path that winds around the outer surface of the mandrel.

11. The apparatus of claim 9, wherein the flow control path includes one of: (i) at least two hydraulically parallel flow paths; and (ii) a helical flow path.

* * * * *